US009302302B2

(12) United States Patent
Yamane

(10) Patent No.: US 9,302,302 B2
(45) Date of Patent: Apr. 5, 2016

(54) MANDREL MILL AND METHOD FOR MANUFACTURING SEAMLESS PIPE OR TUBE

(75) Inventor: Akihito Yamane, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 500 days.

(21) Appl. No.: 13/808,431

(22) PCT Filed: Jul. 6, 2011

(86) PCT No.: PCT/JP2011/065465

§ 371 (c)(1),
(2), (4) Date: Mar. 18, 2013

(87) PCT Pub. No.: WO2012/005287

PCT Pub. Date: Jan. 12, 2012

(65) Prior Publication Data

US 2013/0205860 A1 Aug. 15, 2013

(30) Foreign Application Priority Data

Jul. 7, 2010 (JP) ..... 2010-154494

(51) Int. Cl.

| | |
|---|---|
| ***B21B 17/02*** | (2006.01) |
| ***B21B 17/04*** | (2006.01) |
| ***B21B 27/02*** | (2006.01) |

(52) U.S. Cl.

CPC ..... *B21B 17/02* (2013.01); *B21B 17/04* (2013.01); *B21B 27/024* (2013.01)

(58) Field of Classification Search

CPC .. B21B 27/024; B21B 27/025; B21B 27/027; B21B 17/02; B21B 17/04; B21B 27/028; B21B 37/66; B21B 37/78

See application file for complete search history.

(56) References Cited

U.S. PATENT DOCUMENTS

| | | | | |
|---|---|---|---|---|
| 2006/0059969 | A1 | 3/2006 | Iwamoto et al. | |
| 2008/0289391 | A1 * | 11/2008 | Okui et al. | 72/234 |

FOREIGN PATENT DOCUMENTS

| | | |
|---|---|---|
| EP | 1 707 281 | 10/2006 |
| JP | 7-47410 | 2/1995 |
| JP | 7-314013 | 12/1995 |
| JP | 8-187502 | 7/1996 |
| JP | 2006-272340 | 10/2006 |

* cited by examiner

*Primary Examiner* — Debra Sullivan
(74) *Attorney, Agent, or Firm* — Clark & Brody

(57) ABSTRACT

A mandrel mill a method for manufacturing a seamless pipe by using the mandrel mill includes a plurality of roll stands in which three grooved rolls R are disposed in each roll stand such that an angle formed by pressing directions is 120° and the pressing directions of the grooved rolls R are alternately shifted by 60° between adjacent roll stands, wherein a central angle θ defining a circular arc that constitutes a groove bottom profile of the grooved roll R disposed at least in the first and second roll stands is set at less than 60°. The mandrel mill can adequately suppress the problem of the mandrel bar not being able to be pulled out from a pipe after drawing and rolling, without resulting in an increase in facility cost and deterioration of maintainability.

3 Claims, 8 Drawing Sheets

| | Comparative example 1 | Example 1-1 | Example 1-2 | Example 1-3 |
|---|---|---|---|---|
| Cross-sectional shape at the exit side of fifth roll stand (shown in exaggeration) |   |   |   |   |
| Ratio of contact between pipe and mandrel bar | 68% | 50% | 49% | 49% |
| Pipe inner circumference / Mandrel bar outer circumference | 1.0011 | 1.0070 | 1.0028 | 1.0089 |

| | Comparative example 2 | Example 2-1 | Example 2-2 |
|---|---|---|---|
| Cross-sectional shape at the exit side of fifth roll stand (shown in exaggeration) |   |   |   |
| Ratio of contact between pipe and mandrel bar | 86% | 56% | 41% |
| Pipe inner circumference / Mandrel bar outer circumference | 1.0003 | 1.0015 | 1.0024 |

| | Comparative example 3 | Example 3 |
|---|---|---|
| Cross-sectional shape at the exit side of fifth roll stand (shown in exaggeration) |   |   |
| Ratio of contact between pipe and mandrel bar | 86% | 60% |
| Pipe inner circumference / Mandrel bar outer circumference | 1. 0003 | 1. 0006 |

| | Comparative example 4 | Example 4 |
|---|---|---|
| Cross-sectional shape at the exit side of fifth roll stand (shown in exaggeration) |   |   |
| Ratio of contact between pipe and mandrel bar | 68% | 57% |
| Pipe inner circumference / Mandrel bar outer circumference | 1.0011 | 1.0022 |

MANDREL MILL AND METHOD FOR MANUFACTURING SEAMLESS PIPE OR TUBE

TECHNICAL FIELD

The present invention relates to a mandrel mill including a plurality of roll stands, in each of which three grooved rolls are disposed, and a method for manufacturing a seamless pipe or tube by using the mandrel mill. In particular, the present invention relates to a mandrel mill which is capable of adequately suppressing a phenomenon in which when a blank pipe or tube is subjected to drawing and rolling, a circumference of the blank pipe is excessively reduced and thereby an inner surface of the blank pipe squeezes a mandrel bar, thus making the mandrel bar unable to be pulled out from a pipe after drawing and rolling, and a method for manufacturing a seamless pipe by using the mandrel mill. Hereinafter, "pipe or tube" is referred to as "pipe" when deemed appropriate.

BACKGROUND ART

In the manufacturing of a seamless pipe by the Mannesmann-mandrel mill process, first, a round billet or square billet is heated in a heating furnace and thereafter pierced and rolled by a piercing mill to manufacture a hollow blank pipe. Next, a mandrel bar is inserted into the inner face of the hollow blank pipe to be subjected to drawing and rolling by a mandrel mill including a plurality of roll stands. Thereafter, the pipe after drawing and rolling is rolled into a predetermined outer diameter by means of a reducing mill, thus providing a product.

As the mandrel mill described above, conventionally, widely used is a 2-roll type mandrel mill including a plurality of roll stands, in which two opposing grooved rolls are disposed in each roll stand, and the pressing directions of the grooved rolls are alternately shifted by 90° between adjacent roll stands.

In this 2-roll type mandrel mill, there is a risk that scoring may occur between a grooved roll and a blank pipe in the vicinity of a flange of the grooved roll caused by an excessive difference in circumferential speed between the groove bottom and the flange of the grooved roll, and a flaw (fin flaw) may occur in the blank pipe caused by excessive finning of the blank pipe material at a flange of the grooved roll. In view of preventing such scoring and fin flaws, in the 2-roll type mandrel mill, the grooved roll is generally designed such that the radius of curvature is larger at both ends of the groove profile (the groove shape obtained by sectioning the grooved roll with a plane that passes through the rotation center of the grooved roll). In this case, since the region of the blank pipe corresponding to the vicinity of the flange of the grooved roll is only subject to a tension in the longitudinal direction without being restricted either by the grooved roll or the mandrel bar, it is difficult to control the deformation (bulging) in the pipe circumferential direction. For this reason, a problem exists in that a pinhole defect etc. is likely to occur in a pipe made of a material having a low hot deformability such as a stainless steel.

To solve the above described problems of a 2-roll type mandrel mill, recently, a 3-roll type mandrel mill has become introduced in which three grooved rolls are disposed in each roll stand.

A typical 3-roll type mandrel mill includes a plurality of roll stands, in which three grooved rolls are disposed in each roll stand such that the angle formed by pressing directions is 120°, and the pressing directions of the grooved rolls are alternately shifted by 60° between adjacent roll stands.

In a typical 3-roll type mandrel mill, as described above, the pressing directions of the grooved rolls are alternately shifted by 60° between adjacent roll stands. Therefore, when wall thickness reduction is performed on the entire circumference of a blank pipe by a pair of adjacent roll stands, it is necessary to perform wall thickness reduction on a region of the blank pipe defined by a central angle of 60° per each grooved roll disposed in each roll stand (see FIG. 1B). In other words, the region where wall thickness reduction is not performed by each grooved roll is only the regions of the blank pipe defined by a central angle of 30° respectively corresponding to a region closer to opposite flanges of each grooved roll. Moreover, to perform wall thickness reduction on a region of the blank pipe defined by a central angle of 60°, the central angle defining a circular arc constituting a groove bottom profile (the profile in the vicinity of the grove bottom of a groove profile) of each grooved roll is set at 60° or more.

In contrast, in a 2-roll type mandrel mill, wall thickness reduction will be performed on a region of a blank pipe defined by a central angle of 90° per each grooved roll disposed in each roll stand (see FIG. 1A). In other words, the region where wall thickness reduction is not performed by each grooved roll is the region of the blank pipe defined by a central angle of 45° respectively corresponding to a region closer to opposite flanges of each grooved roll, and the range where wall thickness reduction is not performed is larger compared to the case of a typical 3-roll type mandrel mill.

Therefore, in the case of a typical 3-roll type mandrel mill, since the amount of outward bulge of the blank pipe material during drawing and rolling is smaller compared to the case of a 2-roll type mandrel mill, there is a risk that the circumference of the blank pipe is reduced due to drawing and rolling, and thereby the inner surface of the blank pipe squeezes the mandrel bar so that the mandrel bar becomes unable to be pulled out from a pipe after drawing and rolling.

To solve the problems of a typical 3-roll type mandrel mill as described above, Patent Literature 1 proposes a 3-roll type mandrel mill (claims of Patent Literature 1 etc.) in which the pressing directions of the grooved rolls are shifted by 40° for each roll stand among three roll stands which precede the final roll stand, and each grooved roll disposed in the above described three roll stands is formed so as to come into contact with a region of the blank pipe defined by a central angle of 40° (wall thickness reduction of the concerned region is performed).

To be specific, in the mandrel mill described in Patent Literature 1, the grooved roll disposed in the first and second roll stands is reported to be one which is used in a typical 3-roll type mandrel mill as shown in FIG. 3 of Patent Literature 1 etc. That is, the pressing directions of the grooved rolls are shifted by 60° between the first and second roll stands, and each grooved roll disposed in the first and second roll stands is configured to have a groove profile formed therein such that the grooved roll comes into contact with a region of the blank pipe defined by a central angle of 60° (wall thickness reduction is performed on the concerned region) (the central angle defining a circular arc constituting the groove bottom profile is set at 60°).

Further, the mandrel mill described in Patent Literature 1 is configured such that the pressing directions of the grooved rolls are shifted by 40° for each roll stand among a third to a fifth roll stands, and each grooved roll disposed in the third to fifth roll stands has a groove profile formed therein such that the grooved roll comes into contact with a region of the blank pipe defined by a central angle of 40° (wall thickness reduction is performed on the concerned region) (the central angle defining the circular arc constituting the groove bottom profile is set at) 40°.

In other words, in the mandrel mill described in Patent Literature 1, the region where wall thickness reduction is not performed by each grooved roll disposed in the third to fifth roll stands is a region of the blank pipe defined by a central angle of 40° respectively corresponding to the region closer to opposite flanges of each grooved roll, and the range where wall thickness reduction is not performed is larger compared with the case of a typical 3-roll type mandrel mill. Therefore, in the mandrel mill described in Patent Literature 1, the amount of outward bulge of the blank pipe material during drawing and rolling will become larger in the third to fifth roll stands compared to the case of a typical 3-roll type mandrel mill.

CITATION LIST

Patent Literature

[Patent Literature 1] JP7-47410A

SUMMARY OF INVENTION

Technical Problem

However, from the investigation conducted by the present inventors, it is found that in the mandrel mill described in Patent Literature 1, particularly when the blank pipe material is a high alloyed steel such as a stainless steel, the phenomenon in which the mandrel bar becomes unable to be pulled out from a pipe after drawing and rolling cannot be adequately suppressed.

Moreover, in the mandrel mill described in Patent Literature 1, while the pressing directions of grooved rolls are shifted by 60° between the first and second roll stands, the pressing directions of the grooved rolls are shifted by 40° for each roll stand among the third to fifth roll stands. As a result of this, in the mandrel mill described in Patent Literature 1, in contrast to a typical 3-roll type mandrel mill in which the pressing directions of grooved rolls are alternately shifted by 60° in a range from the first roll stand to the final roll stand, the arrangement of the rotary drive shaft etc. of the grooved roll will become complicated thereby resulting in increase in facility cost and deterioration of maintainability.

Further, while in a typical 3-roll type mandrel mill, wall thickness reduction is performed on the entire circumference of the blank pipe in adjacent two roll stands, the wall thickness reduction is performed on the entire circumference of the blank pipe in three roll stands (a third to a fifth roll stands) in the mandrel mill described in Patent Literature 1. For this reason, in the mandrel mill described in Patent Literature 1, the number of roll stands increases compared to a typical 3-roll type mandrel mill, thereby resulting in increase in facility cost and deterioration of maintainability.

The present invention has been made to solve such problems of prior art, and has its object to provide a mandrel mill including a plurality of roll stands in which three grooved rolls are disposed in each roll stand, and which can adequately suppress a phenomenon in which the mandrel bar becomes unable to be pulled out from a pipe after drawing and rolling, without resulting in increase in facility cost and deterioration of maintainability, and a method for manufacturing a seamless pipe by using the mandrel mill.

Solution to Problem

In order to solve the above described problems, the present inventors have conducted a diligent study eventually obtaining the following findings.

Since, in the mandrel mill described in Patent Literature 1, the grooved roll disposed in the first and second roll stands is a grooved roll which is used in a typical 3-roll type mandrel mill (a grooved roll in which the groove profile is formed such that the grooved roll comes into contact with a region of the blank pipe defined by a central angle of 60°), the amount of outward bulge of the blank pipe material during drawing and rolling in the first and second roll stands is small, thereby resulting in a smaller circumference of the blank pipe. In particular, when the blank pipe material is a high alloyed steel such as a stainless steel, since in addition to that the amount of outward bulge of the blank pipe material will be further reduced, the high alloyed steel has a high thermal shrinkage ratio, the shrinkage of the circumference of the blank pipe will remarkably increase. Accordingly, it is found that once the circumference of the blank pipe has become excessively small due to the drawing and rolling in the first and second roll stands, even if the blank pipe is subjected to drawing and rolling by a grooved roll which is formed such that the amount of outward bulge of the blank pipe material increases during drawing and rolling in the third to fifth roll stands (a grooved roll in which groove profile is formed such that the grooved roll comes into contact with a region of the blank pipe defined by a central angle of 40°), the circumference of the pipe after the drawing and rolling will not increase, and the phenomenon in which the mandrel bar becomes unable to be pulled out from a pipe after drawing and rolling cannot be adequately suppressed. In other words, the present inventors found that to adequately suppress the phenomenon in which the mandrel bar becomes unable to be pulled out from a pipe after drawing and rolling, it is essential to form the grooved roll such that the amount of outward bulge of the blank pipe material increases during drawing and rolling at least in the first and second roll stands.

The present invention has been achieved based on the above findings of the present inventors. That is, the present invention provides a mandrel mill comprising a plurality of roll stands in which three grooved rolls are disposed in each roll stand such that an angle formed by pressing directions is 120° and the pressing directions of grooved rolls are alternately shifted by 60° between adjacent roll stands, wherein a central angle defining a circular arc that constitutes a groove bottom profile in a groove profile of the grooved rolls disposed at least in the first and second roll stands is set at less than 60°, and a distance between a point on the groove profile excepting the groove bottom profile and a center of the circular arc is longer than a radius of the circular arc.

In the mandrel mill relating to the present invention, the central angle defining a circular arc constituting a groove bottom profile (a profile of the vicinity of the groove bottom in a groove profile) of the grooved rolls disposed at least in the first and second roll stands is set at less than 60°. Further, the distance between a point on the groove profile excepting the groove bottom profile and the center of the circular arc is longer than the radius of the circular arc. Therefore, compared to a conventional typical 3-roll type mandrel mill, the amount of outward bulge of the blank pipe or tube material during drawing and rolling at least in the first and second stand rolls is large, and even if the blank pipe or tube material is a high alloyed steel such as a stainless steel, it is possible to increase the circumference of the pipe after drawing and rolling. Therefore, it is possible to adequately suppress the phenomenon in which the mandrel bar becomes unable to be pulled out from a pipe or tube after drawing and rolling.

Further, since in the mandrel mill relating to the present invention, the pressing directions of the grooved rolls are alternately shifted by 60° in all the roll stands as with a typical 3-roll type mandrel mill, the arrangement of the rotary drive shaft etc. of the grooved roll will not become complicated unlike the mandrel mill described in Patent Literature 1. Furthermore, the number of roll stands may be the same as that of a typical 3-roll type mandrel mill. Therefore, increase in facility cost and deterioration of maintainability will not result.

As so far described, according to the mandrel mill relating to the present invention, it is possible to adequately suppress the phenomenon in which the mandrel bar becomes unable to be pulled out from a pipe or tube after drawing and rolling, without resulting in increase in facility cost and deterioration of maintainability.

Moreover, configuring not only the grooved rolls disposed in the first and second roll stands, but also the grooved rolls disposed in the roll stands after the third roll stand such that the central angle defining a circular arc constituting the groove bottom profile is set at less than 60°, and the distance between a point on the groove profile excepting the groove bottom profile and the center of the circular arc is larger than the radius of the circular arc, will make it possible to more adequately suppress the phenomenon in which the mandrel bar becomes unable to be pulled out from a pipe or tube after drawing and rolling.

Here, it is preferable that the central angle defining the circular arc constituting the groove bottom profile of the grooved rolls disposed at least in the first and second roll stands is set at not less than 30°. If the central angle is set at less than 30°, the region where wall thickness reduction is not performed in one roll stand will exceed ¾ of the entire circumference of the blank pipe or tube, and even with the first and second roll stands combined, the region where wall thickness reduction is not performed will exceed ½ of the entire circumference of the blank pipe or tube. For this reason, the amount of reduction in wall thickness in the roll stands after the third roll stand becomes larger than that in the first and second roll stands resulting in a risk that the number of the roll stands after the third roll stand has to be increased.

Further, the "first roll stand" in the present invention refers to a roll stand which is disposed at a first position counted from the entrance side of the mandrel mill. Similarly, the "second roll stand" in the present invention refers to a roll stand which is disposed at a second position counted from the entrance side of the mandrel mill.

Here, it is known that when three grooved rolls are disposed in each roll stand such that the angle formed by pressing directions is 120°, and the pressing directions of the grooved rolls are alternately shifted by 60° between adjacent roll stands, the wall thickness of a region of the blank pipe or tube (hereafter appropriately referred to as "intermediate portion" since it is a region which is rolled at an intermediate region between the groove bottom and the flange of the grooved roll) which is rolled by the region of each grooved roll located from the groove bottom to an angle of near 30° around the groove center tends to be larger than the wall thickness of other regions.

Therefore, in the final roll stand among the roll stands for performing wall thickness reduction on a blank pipe or tube, the wall thickness reduction may be mainly performed on the above described intermediate portion from the viewpoint of preventing wall thickness eccentricity.

However, in the final roll stand of a conventional typical 3-roll type mandrel mill, it is general that the distance between a point on the groove profile of the grooved roll and the groove center is approximately constant over a range from the groove bottom to a region located at an angle of near 30° around the groove center. For this reason, in a wide range in a circumferential direction of the blank pipe or tube including not only the above described intermediate portion but also a region opposed to the groove bottom of the grooved roll, wall thickness reduction is performed on the blank pipe or tube between the grooved roll and the mandrel bar. Therefore, the major bulging direction of the blank pipe or tube material during drawing and rolling in the final roll stand will be the longitudinal direction of the blank pipe or tube, and the amount of bulge in the circumferential direction of the blank pipe or tube is small so that the circumference of a pipe or tube after drawing and rolling becomes small. As a result of this, there is a risk that the phenomenon in which the mandrel bar becomes unable to be pulled out from a pipe or tube after drawing and rolling cannot adequately be suppressed.

The inventors have conducted a diligent study in view of that forming a profile of the grooved roll such that the blank pipe or tube material mainly bulges in the circumferential direction of the blank pipe or tube during drawing and rolling in the final roll stand allows the circumference of the pipe or tube after drawing and rolling to be increased, thereby making it possible to further adequately suppress the phenomenon in which the mandrel bar becomes unable to be pulled out from a pipe or tube after drawing and rolling, and that wall thickness reduction may be mainly performed on the above described intermediate portion in the final roll stand, and eventually came to think of a preferred configuration of the mandrel mill relating to the present invention.

That is, preferably, a distance between a point of the groove profile of each grooved roll disposed in a final roll stand among roll stands for performing wall thickness reduction on a blank pipe or tube, and a groove center is not constant, and becomes a minimum at a point on the groove profile located at any angle in a range of not less than 27° and not more than 33° around the groove center from the groove bottom.

According to such a preferable configuration, since in the final roll stand, the distance between a point on the groove profile and the groove center is not constant, but becomes a minimum at a point on the groove profile located at an angle of near 30° (not less than 27° and not more than 33°) around the groove center from the groove bottom, wall thickness reduction will be performed on the blank pipe or tube between the grooved roll and the mandrel bar only in the periphery of the intermediate portion described above. For this reason, since the major direction in which the blank pipe or tube material bulges during drawing and rolling in the final roll stand will be the circumferential direction of the blank pipe or tube, the circumference of the pipe or tube after drawing and rolling increases compared with the case where drawing and rolling is performed in a final roll stand in which a grooved roll having a groove profile as in prior art is disposed. As a result of this, it is made possible to further adequately suppress the phenomenon in which the mandrel bar becomes unable to be pulled out from a pipe or tube after drawing and rolling.

It is noted that "the final roll stand among the roll stands for performing wall thickness reduction on a blank pipe or tube" in the present invention refers to a roll stand which is disposed closest to the exit side of the mandrel mill among the roll stands for performing wall thickness reduction on a blank pipe or tube.

In order to solve the above described problems, the present invention also provides a mandrel mill including a plurality of roll stands in which three grooved rolls are disposed in each roll stand such that the angle formed by pressing directions is 120° and the pressing directions of grooved rolls are alternately shifted by 60° between adjacent roll stands, wherein a distance between a point of the groove profile of each grooved roll disposed in a final roll stand among roll stands for performing wall thickness reduction on a blank pipe or tube, and a groove center is not constant, and becomes a minimum at a point on the groove profile located at any angle in a range of not less than 27° and not more than 33° around the groove center from the groove bottom.

According to the present invention, since in the final roll stand, the distance between a point on the groove profile and the groove center is not constant, but becomes a minimum at a point on the groove profile located at an angle of near 30° (not less than 27° and not more than 33°) around the groove center from the groove bottom, wall thickness reduction will be performed on the blank pipe or tube between the grooved roll and the mandrel bar only in the periphery of the intermediate portion described above. For this reason, since the major direction in which the blank pipe or tube material bulges during drawing and rolling in the final roll stand will be the circumferential direction of the blank pipe or tube, the circumference of the pipe or tube after drawing and rolling increases compared with the case where drawing and rolling is performed in a final roll stand in which a grooved roll having a groove profile as in prior art is disposed. As a result of this, it is made possible to further adequately suppress the phenomenon in which the mandrel bar becomes unable to be pulled out from a pipe or tube after drawing and rolling.

Further, since in the mandrel mill relating to the present invention, the pressing directions of the grooved rolls are alternately shifted by 60° in all the roll stands as with a typical 3-roll type mandrel mill, the arrangement of the rotary drive shaft etc. of the grooved roll will not become complicated unlike the mandrel mill described in Patent Literature 1. Furthermore, the number of roll stands may be the same as that of a typical 3-roll type mandrel mill. Therefore, increase in facility cost and deterioration of maintainability will not result.

As so far described, according to the mandrel mill relating to the present invention, it is possible to adequately suppress the phenomenon in which the mandrel bar becomes unable to be pulled out from a pipe or tube after drawing and rolling, without resulting in increase in facility cost and deterioration of maintainability.

In order to solve the above described problems, the present invention further provides a method for manufacturing a seamless pipe or tube, comprising a step of drawing and rolling a blank pipe or tube by means of the above described mandrel mill.

Advantageous Effects of Invention

According to the mandrel mill relating to the present invention, it is possible to adequately suppress the phenomenon in which the mandrel bar becomes unable to be pulled out from a pipe or tube after drawing and rolling, without resulting in increase in facility cost and deterioration of maintainability.

DESCRIPTION OF EMBODIMENTS

Hereafter, embodiments of the present invention will be described appropriately referring to the appended drawings.

First Embodiment

A mandrel mill relating to the present embodiment includes a plurality of (five in the present embodiment) roll stands in which three grooved rolls are disposed in each roll stand such that an angle formed by the pressing directions is 120°, and the pressing directions of the grooved rolls are alternately shifted by 60° between adjacent roll stands.

Figure 1A:
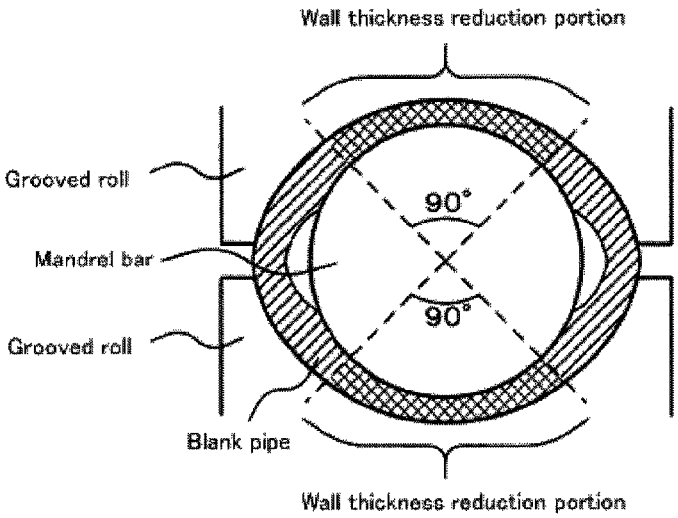
FIGS. 1A and 1B are longitudinal cross-sectional views illustrating the difference between a 2-roll type mandrel mill and a 3-roll type mandrel mill.
Figure 1B:
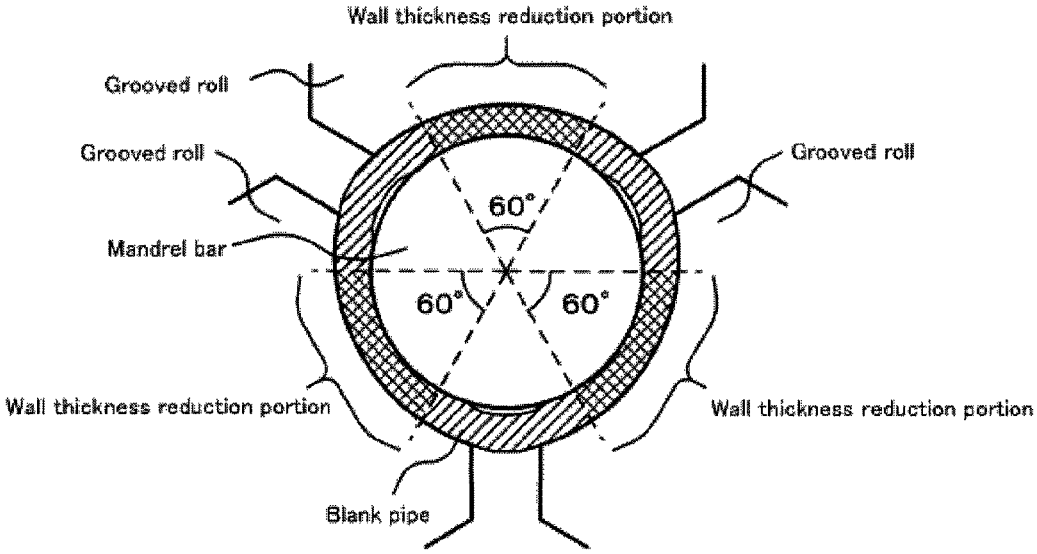
Figure 2A:
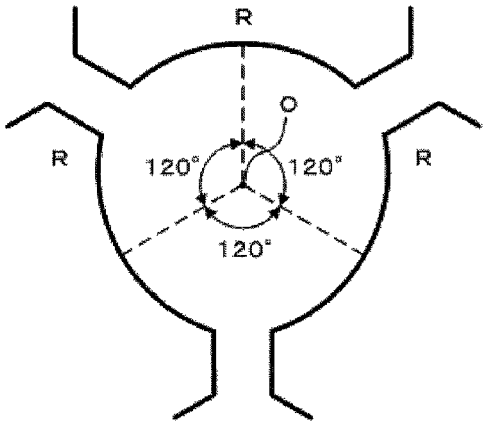
FIGS. 2A, 2B and 2C are longitudinal cross-sectional views schematically showing the configuration of a grooved roll disposed in a first and second roll stands of a mandrel mill relating to one embodiment of the present invention.
Figure 2B:
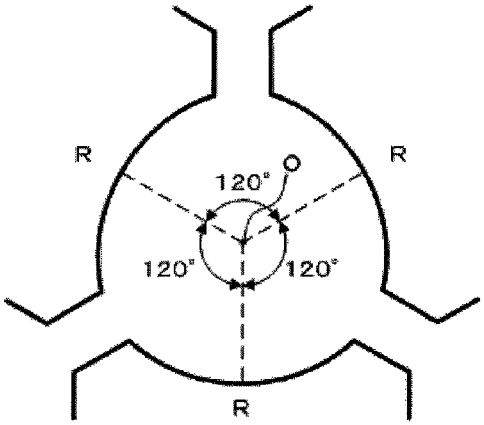
Figure 2C:
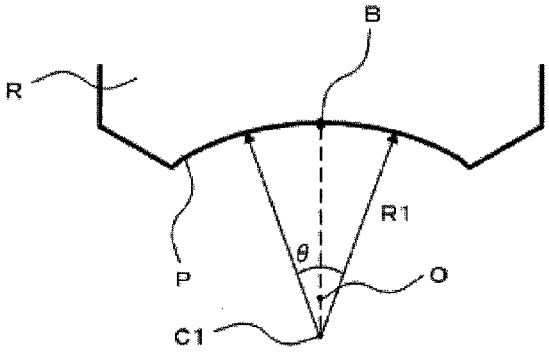

FIGS. 2A, 2B and 2C are longitudinal cross-sectional views schematically showing the configuration of a grooved roll disposed in a first and second roll stands of a mandrel mill relating to the present embodiment. FIG. 2A shows a schematic configuration of three grooved rolls disposed in the first roll stand. FIG. 2B shows a schematic configuration of three grooved rolls disposed in the second roll stand. FIG. 2C shows a schematic configuration of each grooved roll disposed in the first and second roll stands. In FIGS. 2A, 2B and 2C, reference character O indicates a groove center (a pass line center of the blank pipe), and reference character C1 indicates the center of a circular arc having a radius of R1. The distance (offset) between the groove center O and the center C1 of a circular arc is adjusted when blank pipes having different outer diameters and wall thicknesses are subjected to drawing and rolling with the same grooved roll, and is determined to be an appropriate value according to the outer diameter and wall thickness of the blank pipe to be subjected to drawing and rolling.

As shown in FIGS. 2A, 2B and 2C, the mandrel mill relating to the present embodiment is configured such that the central angle θ defining a circular arc (radius R1) constituting a groove bottom profile of a grooved roll R disposed at least in the first and second roll stands is set at less than 60°, and the distance between a point on the groove profile P excepting the groove bottom profile and the center C1 of the circular arc is longer than the radius R1 of the circular arc. Owing to such a configuration, in the mandrel mill relating to the present embodiment, the amount of outward bulge of a blank pipe material during drawing and rolling is larger at least in the first and second roll stands compared to a conventional typical 3-roll type mandrel mill, and it is possible to increase the circumference of the pipe after drawing and rolling even if the blank pipe material is a high alloyed steel such as a stainless steel. Thus, it is possible to adequately suppress the phenomenon in which the mandrel bar becomes unable to be pulled out from a pipe after drawing and rolling.

It is to be noted that the central angle θ defining the circular arc constituting the groove bottom profile of each grooved roll R disposed at least in the first and second roll stands is preferably set at not less than 30°. If the central angle θ is set at less than 30°, the region where wall thickness reduction is not performed in one roll stand will exceed ¾ of the entire circumference of the blank pipe, and even with the first and second roll stands combined, the region where wall thickness reduction is not performed will exceed ½ of the entire circumference of the blank pipe. For this reason, the amount of reduction in wall thickness in the roll stands after the third roll stand becomes larger than that in the first and second roll stands resulting in a risk that the number of the roll stands after the third roll stand has to be increased.

Figure 3A:
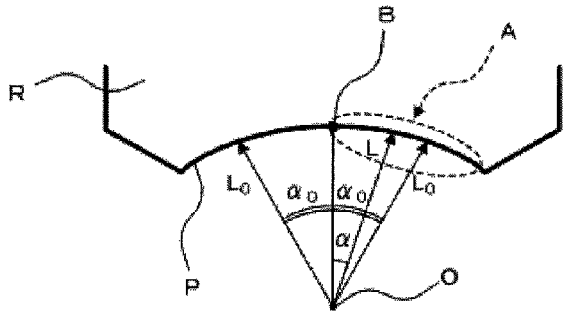
FIGS. 3A, 3B and 3C are longitudinal cross-sectional views schematically showing a preferable configuration of a grooved roll disposed in a final roll stand among the roll stands for performing wall thickness reduction on a blank pipe in the mandrel mill relating to one embodiment of the present invention.
Figure 3B:
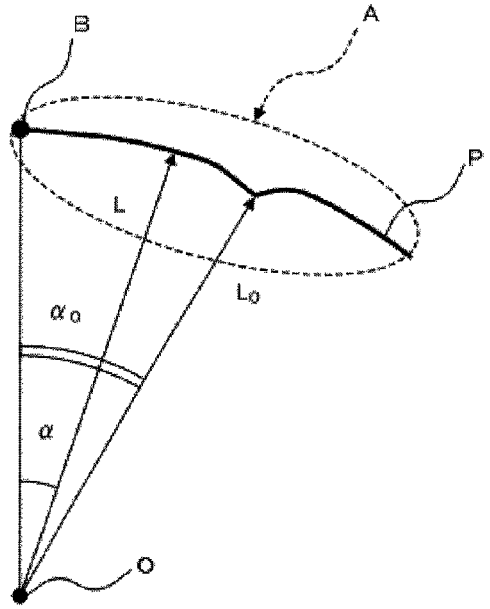
Figure 3C:
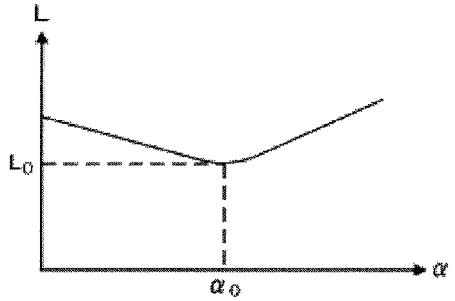

FIGS. 3A, 3B and 3C are longitudinal cross-sectional views schematically showing a preferable configuration of a grooved roll disposed in a final roll stand (a fifth roll stand in the present embodiment) among the roll stands for performing wall thickness reduction on a blank pipe in the mandrel mill relating to the present embodiment. FIG. 3A shows a schematic configuration of each grooved roll disposed in the fifth roll stand. FIG. 3B shows in exaggeration a portion indicated by an arrow symbol A of the groove profile shown in FIG. 3A. FIG. 3C schematically shows the distance between the groove profile and the groove center of each grooved roll disposed in the fifth roll stand. In FIGS. 3A, 3B and 3C, reference character L indicates the distance between a point on the groove profile P, which is located at an angle α around the groove center O from the groove bottom B, and the groove center O.

As shown in FIGS. 3A, 3B and 3C, in a preferable configuration of the mandrel mill relating to the present embodiment, the distance L between a point on the groove profile P and the groove center O of the grooved roll R disposed in the final roll stand (the fifth roll stand) is not constant, and becomes a minimum value $L_0$ at a point on the groove profile P located at an angle $\alpha_0$ ($27° \leq \alpha_0 \leq 33°$) around the groove center O from the groove bottom B. That is, at $\alpha=\alpha_0$, the distance L between a point on the groove profile P and the groove center O is given as $L=L_0$.

Figure 4A:
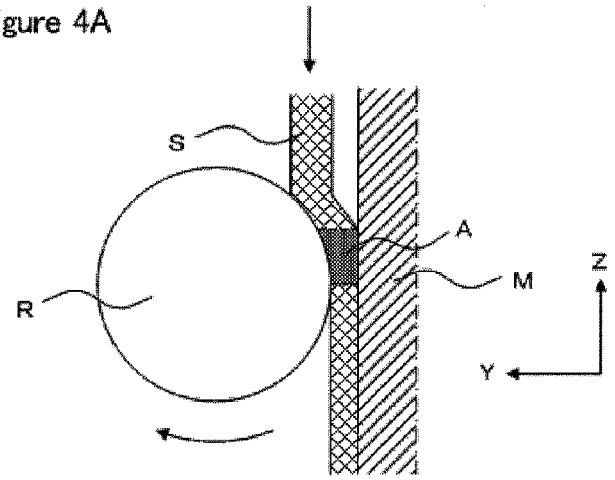
FIGS. 4A, 4B and 4C are explanatory diagrams for illustrating the effect of a grooved roll disposed in the final roll stand shown in FIGS. 3A, 3B and 3C.
Figure 4B:
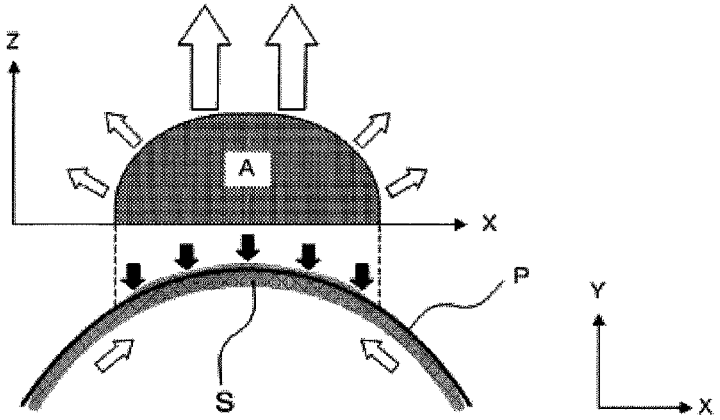
Figure 4C:
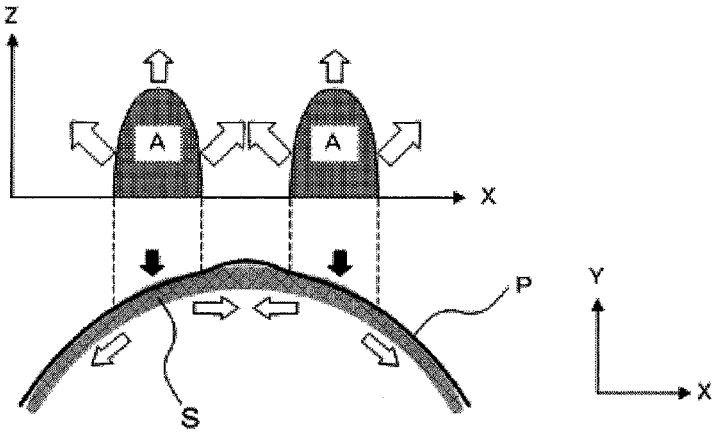

FIGS. 4A, 4B and 4C are explanatory diagrams for illustrating the effect of a grooved roll disposed in the final roll stand shown in FIGS. 3A, 3B and 3C. FIG. 4A is a cross-sectional view schematically showing a situation where a blank pipe S is subjected to drawing and rolling by a grooved roll R and a mandrel bar M. FIG. 4B is a view schematically showing a wall thickness reduction region A in a conventional final roll stand. The figure on the upper side of FIG. 4B shows a view seen from the pressing direction of the grooved roll R, and the figure on the lower side shows a view seen from the roll direction. FIG. 4C is a view schematically showing a wall thickness reduction region A in a final roll stand in which the grooved roll shown in FIGS. 3A, 3B and 3C is disposed. The figure on the upper side of FIG. 4C shows a view seen from the pressing direction of the grooved roll R, and the figure on the lower side shows a view seen from the roll direction. In FIGS. 4A, 4B and 4C, reference character X indicates the circumferential direction of the blank pipe S, reference character Y indicates the pressing direction by the grooved roll R, and reference character Z indicates the roll direction. Moreover, in FIGS. 4A, 4B and 4C, hollow arrow symbols indicate the flow of the blank pipe material, and solid black arrow symbols indicate wall thickness reduction locations. Further, a blank pipe S in FIGS. 4B and 4C indicates the blank pipe at the entrance side of the final roll stand.

In a conventional final roll stand, it is general that the distance between a point on the groove profile P of the grooved roll R and the groove center O is approximately constant over a range from the groove bottom B to a region located at an angle of near 30° around the groove center O. For this reason, as shown in FIG. 4B, in a wide range A in the circumferential direction of the blank pipe S including not only an intermediate portion (a region of the blank pipe S which is rolled at a region of each grooved roll R located from the groove bottom B to an angle of near 30° around the groove center O), but also a region opposed to the groove bottom B of the grooved roll R, wall thickness reduction will be performed on the blank pipe S between the grooved roll R and the mandrel bar M. Thus, the major bulging direction of the blank pipe material during drawing and rolling in the final roll stand will be the longitudinal direction (Z direction) of the blank pipe S, and the amount of bulging in the circumferential direction (X direction) of the blank pipe S is small so that the circumference of the pipe after drawing and rolling will have become small. As a result of this, there is a risk that it is not possible to adequately suppress the phenomenon in which the mandrel bar M becomes unable to be pulled out from a pipe after drawing and rolling.

On the other hand, in the final roll stand in which the grooved roll R shown in FIGS. 3A, 3B and 3C is disposed, the distance L between a point on the groove profile P and the groove center O is not constant, and becomes a minimum value $L_0$ at a point on the groove profile P located at an angle $\alpha_0$ of near 30° (not less than 27° and not more than 33°) around the groove center O from the groove bottom B. As a result of this, as shown in FIG. 4C, wall thickness reduction will be performed on the blank pipe S between the grooved roll R and the mandrel bar M only in the periphery A of the intermediate portion described above. For this reason, the major direction in which the blank pipe material bulges during drawing and rolling in the final roll stand will be the circumferential direction (X direction) of the blank pipe S, the circumference of the pipe after drawing and rolling becomes larger compared to a case where drawing and rolling is performed in a conventional final roll stand (FIG. 4B). As a result of this, it is possible to further adequately suppress the phenomenon in which the mandrel bar M becomes unable to be pulled out from a pipe after drawing and rolling.

Second Embodiment

A mandrel mill relating to the present embodiment includes, as with the first embodiment, a plurality of (five in the present embodiment) roll stands in which three grooved rolls are disposed in each roll stand such that an angle formed by the pressing directions is 120°, and the pressing directions of the grooved rolls are alternately shifted by 60° between adjacent roll stands.

Moreover, as with a preferable configuration of the mandrel mill relating to the first embodiment as described with reference to FIGS. 3A, 3B and 3C, in the mandrel mill relating to the present embodiment as well, the distance L between a point on the groove profile P and the groove center O of the grooved roll R disposed in the final roll stand (the fifth roll stand) is not constant, and becomes a minimum value $L_0$ at a point on the groove profile P located at an angle $\alpha_0$ ($27° \leq \alpha_0 \leq 33°$) around the groove center O from the groove bottom B. That is, at $\alpha=\alpha_0$, the distance L between the groove profile P and the groove center O is given as $L=L_0$.

However, as to the mandrel mill relating to the present embodiment, in contrast to the mandrel mill relating to the first embodiment, there is no restriction that the central angle θ defining a circular arc (radius R1) constituting the groove bottom profile of the grooved roll R disposed at least in the first and second roll stands be set at less than 60°.

As described above, in the final roll stand of the mandrel mill relating to the present embodiment, the distance L between a point on the groove profile P and the groove center O is not constant, and becomes a minimum value $L_0$ at a point on the groove profile P located at an angle $\alpha_0$ of near 30° (not less than 27° and not more than 33°) around the groove center O from the groove bottom B. For this reason, as to the mandrel mill relating to the present embodiment as well, as with the preferable configuration of the mandrel mill relating to the first embodiment described above with reference to FIGS. 4A, 4B and 4C, as shown in FIG. 4C, wall thickness reduction will be performed on the blank pipe S between the grooved roll R and the mandrel bar M only in the periphery A of the intermediate portion described above (a region of the blank pipe S which is rolled at a region of grooved roll R located from the groove bottom B to an angle of near 30° around the groove center O). For this reason, since the major direction in which the blank pipe material bulges during drawing and rolling in the final roll stand will be the circumferential direction (X direction) of the blank pipe S, the circumference of the pipe after drawing and rolling becomes larger compared with the case where drawing and rolling is performed in a final roll stand in which drawing and rolling is performed by a conventional final roll stand (FIG. 4B). As a result of this, it is made possible to adequately suppress the phenomenon in which the mandrel bar M becomes unable to be pulled out from a pipe after drawing and rolling.

Hereafter, examples and comparative examples of the present invention will be described.

Example 1-1

In a mandrel mill including five roll stands, the cross-sectional shape of a pipe at the exit side of the mandrel mill was evaluated by carrying out analysis using a finite element method (FEM) at conditions that the central angle θ defining a circular arc constituting the groove bottom profile of a grooved roll R is θ=40° for all of the first to fifth roll stands (the distance between a point on the groove profile excepting the groove bottom profile and the center of the circular arc is longer than the radius of the circular arc), the blank pipe material is stainless steel (SUS304), and the pipe at the exit side of the mandrel mill has an outer diameter of 218 mm and a wall thickness of 5.5 mm.

Example 1-2

The cross-sectional shape of a pipe at the exit side of a mandrel mill was evaluated by carrying out analysis using a finite element method (FEM) at the same conditions as those of Example 1-1 excepting that the central angle θ defining the circular arc constituting the groove bottom profile of each grooved roll R disposed in the first to third roll stands is θ=40° (the distance between a point on the groove profile excepting the groove bottom profile and the center of the circular arc is longer than the radius of the circular arc), and the central angle θ defining the circular arc constituting the groove bottom profile of each grooved roll R disposed in the fourth to fifth roll stands is θ=60° (the distance between a point on the groove profile excepting the groove bottom profile and the center of the circular arc is longer than the radius of the circular arc).

Example 1-3

The cross-sectional shape of a pipe at the exit side of a mandrel mill was evaluated by carrying out analysis using a finite element method (FEM) at the same conditions as those of Example 1-1 excepting that the central angle θ defining the circular arc constituting the groove bottom profile of each grooved roll R disposed in the first to fourth roll stands is θ=40° (the distance between a point on the groove profile excepting the groove bottom profile and the center of the circular arc is longer than the radius of the circular arc), and the distance L between a point on the groove profile P and the groove center O of the grooved roll R disposed in the fifth roll stand is not constant, and becomes a minimum at a point on the groove profile P located at an angle of 30° around the groove center O from the groove bottom B.

Comparative Example 1

The cross-sectional shape of a pipe at the exit side of a mandrel mill was evaluated by carrying out analysis using a finite element method (FEM) at the same conditions as those of Example 1-1 excepting that the central angle θ defining the circular arc constituting the groove bottom profile of each grooved roll R disposed in the first to fifth roll stands is θ=60° (the distance between a point on the groove profile excepting the groove bottom profile and the center of the circular arc is longer than the radius of the circular arc).

<Evaluation Results>

Figure 5:
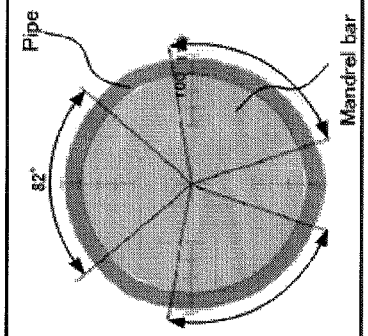
FIG. 5 shows evaluation results of Examples 1-1 to 1-3, and Comparative Example 1.
Figure 5:
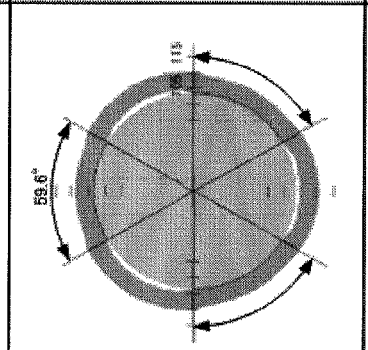
Figure 5:
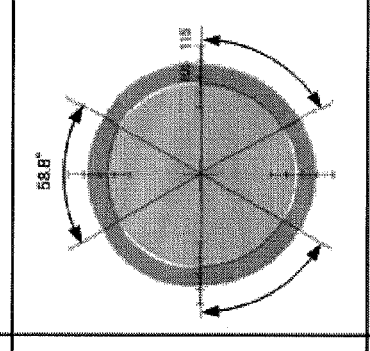
Figure 5:
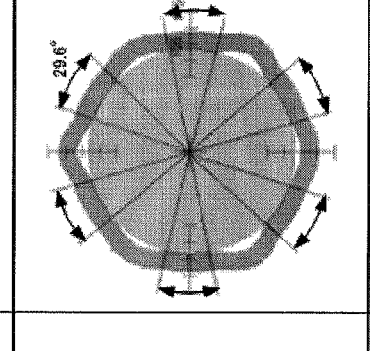

FIG. 5 shows evaluation results of Examples 1-1 to 1-3, and Comparative Example 1. In FIG. 5, an angle range shown by an arrow line shows a range where the pipe and the mandrel bar are in contact with each other. As shown in FIG. 5, the result indicated that the ratio of contact between the pipe and the mandrel bar was reduced and the inner circumference of the pipe increased for any of Examples 1-1 to 1-3 compared to Comparative Example 1. In particular, Example 1-3 resulted in showing the largest inner circumference of the pipe. From these results, it is expected that according to the mandrel mill relating to the present invention, it is possible to adequately suppress the phenomenon in which the mandrel bar becomes unable to be pulled out from a pipe after drawing and rolling.

Example 2-1

In a mandrel mill including five roll stands, the cross-sectional shape of a pipe at the exit side of a mandrel mill was evaluated by carrying out analysis using a finite element method (FEM) at conditions that the central angle θ defining the circular arc constituting the groove bottom profile of each grooved roll R disposed in the first and second roll stands is θ=40° (the distance between a point on the groove profile excepting the groove bottom profile and the center of the circular arc is longer than the radius of the circular arc), and the central angle θ defining the circular arc constituting the groove bottom profile of each grooved roll R disposed in the third to fifth roll stands is θ=60° (the distance between a point on the groove profile excepting the groove bottom profile and the center of the circular arc is longer than the radius of the circular arc), the blank pipe material is stain less steel (SUS304), and the pipe at the exit side of the mandrel mill has an outer diameter of 218 mm and a wall thickness of 4.7 mm.

Example 2-2

The cross-sectional shape of a pipe at the exit side of a mandrel mill was evaluated by carrying out analysis using a finite element method (FEM) at the same conditions as those of Example 2-1 excepting that the distance L between a point on the groove profile P and the groove center O of the grooved roll R disposed in the fifth roll stand is not constant, and becomes a minimum at a point on the groove profile P located at an angle of 30° around the groove center O from the groove bottom B.

Comparative Example 2

The cross-sectional shape of a pipe at the exit side of a mandrel mill was evaluated by carrying out analysis using a finite element method (FEM) at the same conditions as those of Example 2-1 excepting that the central angle θ defining the circular arc constituting the groove bottom profile of each grooved roll R disposed in the first to fifth roll stands is θ=60° (the distance between a point on the groove profile excepting the groove bottom profile and the center of the circular arc is longer than the radius of the circular arc).

<Evaluation Results>

Figure 6:
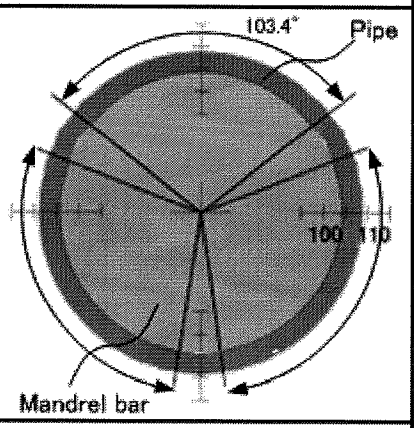
FIG. 6 shows evaluation results of Examples 2-1 and 2-2, and Comparative Example 2.
Figure 6:
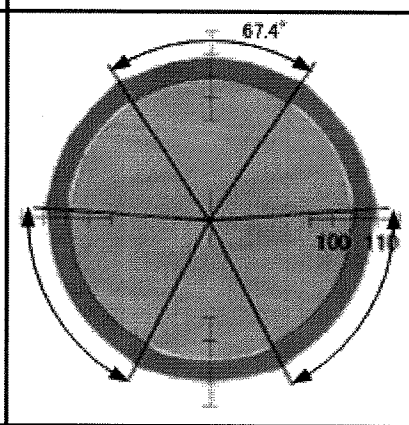
Figure 6:
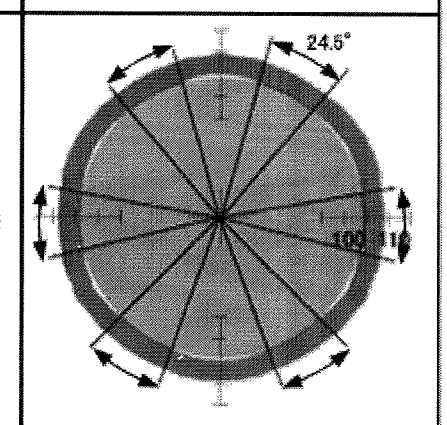

FIG. 6 shows evaluation results of Examples 2-1 and 2-2, and Comparative Example 2. In FIG. 6, an angle range shown by an arrow line shows a range where the pipe and the mandrel bar are in contact with each other. As shown in FIG. 6, the results indicated that the ratio of contact between the pipe and the mandrel bar decreased and the inner circumference of the pipe increased for any of Examples 2-1 and 2-2 compared to Comparative Example 2. In particular, Example 2-2 resulted in showing the largest inner circumference of the pipe. From these results, it is expected that according to the mandrel mill relating to the present invention, it is possible to adequately suppress the phenomenon in which the mandrel bar becomes unable to be pulled out from a pipe after drawing and rolling.

Example 3

In a mandrel mill including five roll stands, the cross-sectional shape of a pipe at the entrance side of the mandrel mill was evaluated by carrying out analysis using a finite element method (FEM) at conditions that the central angle θ defining the circular arc constituting the groove bottom profile of each grooved roll R disposed in the first to fourth roll stands is θ=60° (the distance between a point on the groove profile excepting the groove bottom profile and the center of the circular arc is longer than the radius of the circular arc), the distance L between a point on the groove profile P and the groove center O of the grooved roll R disposed in the fifth roll stand becomes a minimum at a point on the groove profile P located at an angle of 30° around the groove center O from the groove bottom B, the blank pipe material is a stain less steel (SUS304), and the pipe at the exit side of the mandrel mill has an outer diameter of 218 mm and a wall thickness of 4.7 mm.

Comparative Example 3

The cross-sectional shape of a pipe at the exit side of the mandrel mill was evaluated by carrying out analysis using a finite element method (FEM) at the same conditions as those of Example 3 excepting that the distance L between a point on the groove profile P and the groove center O of the grooved roll R disposed in the fifth roll stand is approximately constant over a range from the grove bottom B to a point on the groove profile P located at an angle of 30° around the groove center O from the groove bottom B.

<Evaluation Results>

Figure 7:
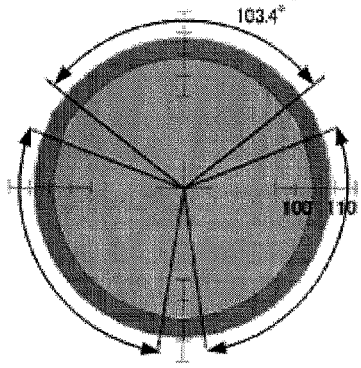
FIG. 7 shows evaluation results of Examples 3 and Comparative Example 3.
Figure 7:
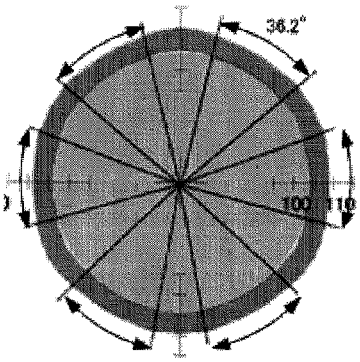

FIG. 7 shows evaluation results of Examples 3 and Comparative Example 3. In FIG. 7, an angle range shown by an arrow line shows a range where the pipe and the mandrel bar are in contact with each other. As shown in FIG. 7, the results indicated that the ratio of contact between the pipe and the mandrel bar decreased, and the inner circumference of the pipe increased for Example 3 compared to Comparative Example 3. From these results, it is expected that according to the mandrel mill relating to the present invention, it is possible to adequately suppress the phenomenon in which the mandrel bar becomes unable to be pulled out from a pipe after drawing and rolling.

Example 4

The cross-sectional shape of a pipe at the exit side of the mandrel mill was evaluated by carrying out analysis using a finite element method (FEM) at the same conditions as those of Example 1-2 excepting that the central angle θ defining the circular arc constituting the groove bottom profile of the grooved roll R disposed in the first roll stand is θ=44° (the distance between a point on the groove profile excepting the groove bottom profile and the center of the circular arc is longer than the radius of the circular arc), the central angle θ defining the circular arc constituting the groove bottom profile of the grooved roll R disposed in the second roll stand is θ=47° (the distance between a point on the groove profile excepting the groove bottom profile and the center of the circular arc is longer than the radius of the circular arc), and the central angle θ defining the circular arc constituting the groove bottom profile of the grooved roll R disposed in the third roll stand is θ=50° (the distance between a point on the groove profile excepting the groove bottom profile and the center of the circular arc is longer than the radius of the circular arc).

Comparative Example 4

The cross-sectional shape of a pipe at the exit side of the mandrel mill was evaluated by carrying out analysis using a finite element method (FEM) at the same conditions as those of Example 4 excepting that the central angle θ defining the circular arc constituting the groove bottom profile of each grooved roll R disposed in the first to fifth roll stands is θ=60° (the distance between a point on the groove profile excepting the groove bottom profile and the center of the circular arc is longer than the radius of the circular arc).

<Evaluation Results>

Figure 8:
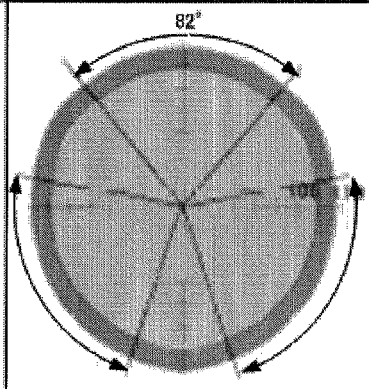
FIG. 8 shows evaluation results of Example 4 and Comparative Example 4.
Figure 8:
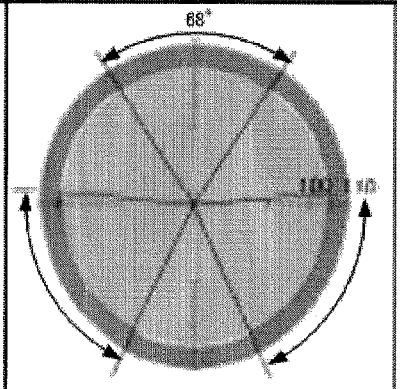

FIG. 8 shows evaluation results of Example 4 and Comparative Example 4. In FIG. 8, an angle range shown by an arrow line shows a range where the pipe and the mandrel bar are in contact with each other. As shown in FIG. 8, the results indicated that the ratio of contact between the pipe and the mandrel bar decreased, and the inner circumference of the pipe increased for Example 4 compared to Comparative Example 4. From these results, it is expected that according to the mandrel mill relating to the present invention, it is possible to adequately suppress the phenomenon in which the mandrel bar becomes unable to be pulled out from a pipe after drawing and rolling.

REFERENCE SIGNS LIST

R Grooved roll
B Groove bottom

P Groove profile

O Groove center

C1 Center of circular arc

θ Central angle of circular arc

The invention claimed is:

1. A mandrel mill including a plurality of roll stands in which three grooved rolls are disposed in each roll stand such that the angle formed by pressing directions is 120° and the pressing directions of grooved rolls are alternately shifted by 60° between adjacent roll stands, wherein a distance between a point of the groove profile of each grooved roll disposed in a final roll stand among roll stands for performing wall thickness reduction on a blank pipe or tube, and a groove center is not constant, and becomes a minimum at a point on the groove profile located at any angle in a range of not less than 27° and not more than 33° around the groove center from the groove bottom.

2. The mandrel mill according to claim 1, wherein a central angle defining a circular arc that constitutes a groove bottom profile in the groove profile of the grooved rolls disposed at least in the first and second roll stands is set at less than 60°, and a distance between a point on the groove profile excepting the groove bottom profile and a center of the circular arc is longer than a radius of the circular arc.

3. A method for manufacturing a seamless pipe or tube, comprising a step of drawing and rolling a blank pipe or tube by means of a mandrel mill according to claim 1.

* * * * *